United States Patent [19]

Rosar et al.

[11] Patent Number: 4,626,806

[45] Date of Patent: Dec. 2, 1986

[54] RF ISOLATION SWITCH

[75] Inventors: George C. Rosar, Owatonna; James R. Wilson, Waseca, both of Minn.

[73] Assignee: E. F. Johnson Company, Waseca, Minn.

[21] Appl. No.: 786,204

[22] Filed: Oct. 10, 1985

[51] Int. Cl.[4] ..... H01P 1/15

[52] U.S. Cl. ..... 333/104; 333/103; 333/262; 307/317 R

[58] Field of Search ..... 333/101-104, 333/161, 164, 246, 245, 258, 262; 307/317 R, 112, 113, 115, 125, 126, 130

[56] References Cited

U.S. PATENT DOCUMENTS

| | | | |
|---|---|---|---|
| 3,230,386 | 1/1966 | Riebman et al. | 333/262 |
| 3,475,700 | 10/1969 | Ertel | 333/104 |
| 3,503,014 | 3/1970 | Hall et al. | 333/104 |
| 3,538,465 | 11/1970 | Manning, Jr. et al. | 333/246 |
| 3,559,108 | 1/1971 | Seidel | 333/103 |
| 3,959,750 | 5/1976 | Holt | 333/262 |
| 3,979,703 | 9/1976 | Craven | 333/258 |
| 4,078,214 | 3/1978 | Beno | 333/203 |
| 4,078,217 | 3/1978 | Beno | 333/262 |
| 4,267,538 | 5/1981 | Assal et al. | 333/262 |

*Primary Examiner*—Marvin L. Nussbaum
*Attorney, Agent, or Firm*—Dorsey & Whitney

[57] ABSTRACT

A solid state radio frequency switching circuit is provided that exhibits up to 25 db isolation between output ports. The circuit integrates the switching versatility of a pin diode switch with the excellent signal isolation of a quarter wavelength combiner.

6 Claims, 1 Drawing Figure

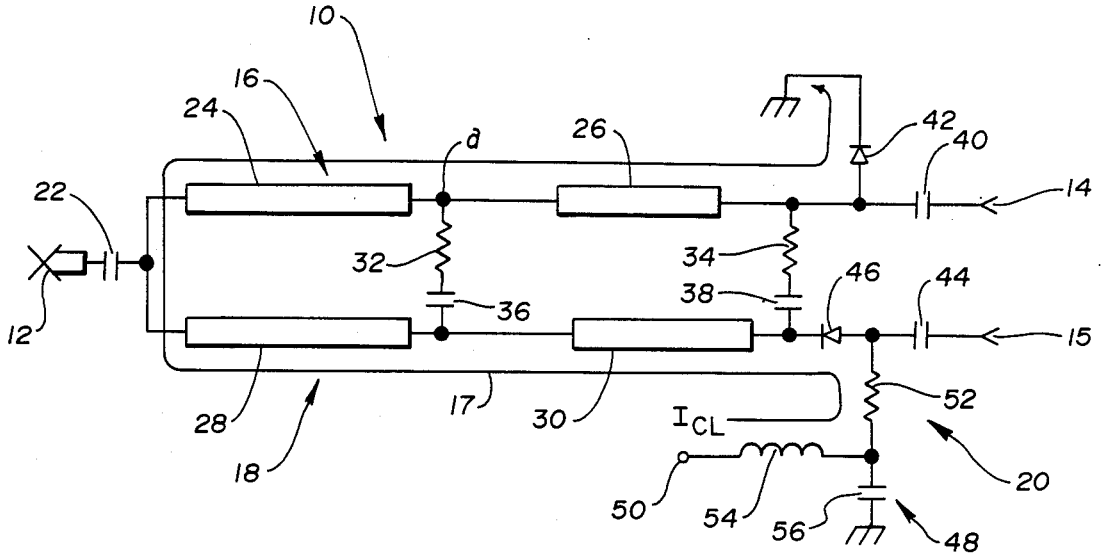
10
16
24
a
26
42
40
22
14
32
34
46
44
36
38
12
15
28
17
30
52
$I_{CL}$
18
20
50
54
56
48

RF ISOLATION SWITCH

TECHNICAL FIELD

The invention herein described pertains to radio frequency (RF) isolation switches. In particular, it pertains to a pin diode single pole double throw switch having up to approximately 25 db isolation between output ports of the switch.

BACKGROUND ART

Single pole double throw (SPDT) pin diode switches provide a convenient way of coupling a single input signal to one of a plurality of output terminals. Pin diode SPDTs are completely electronic, as opposed to mechanical, in design, and therefore inherently present various feedback paths between the plurality of terminals of the switch. Quarter wavelength combiners, such as the well-known Wilkinson combiner, provide excellent signal isolation between two output ports serviced by the same input port. A circuit that would combine the versatility of a pin diode SPDT switch, with the isolation characteristics of a quarter wavelength combiner, would have a multitude of applications.

SUMMARY OF THE INVENTION

The RF isolation switch disclosed herein combines the versatility of the pin diode single pole double throw (SPDT) switch with the isolation characteristics of a quarter wavelength combiner. In particular, the circuit described herein provides for switching between a plurality of output ports at a rapid rate characteristic of solid state switches, while providing approximately 25 db isolation between the output ports. The DC path running between branches of the quarter wavelength combiner is used for mutual biasing of the pin diodes in the circuit. Blocking capacitors are used in series with the balancing resistors of the combiner to maintain the voltage balancing effect of the resistors as seen by AC signals.

BRIEF DESCRIPTION OF THE DRAWINGS

FIG. 1 is a schematic drawing of the radio frequency isolation switch in accordance with the present invention.

DETAILED DESCRIPTION OF THE DRAWINGS

Referring to the drawing, a single pole double throw RF isolation switch 10 is depicted connecting a single input terminal 12 with a pair of output ports 14, 15. The switch 10 broadly includes first and second branches 16, 17 of a modified Wilkinson combiner 18, and switching network 20. The modified Wilkinson combiner 18 is connected to the input terminal 12 via DC blocking capacitor 22.

The first branch 16 of the modified Wilkinson combiner 18 comprises first and second quarter wavelength tranmission lines 24, 26. The second branch 17 of the modified Wilkinson combiner 18 comprises first and second quarter wavelength transmission lines 28, 30. Balancing resistors 32, 34, each in series with a DC blocking capacitor 36, 38 interconnect the branches 16, 17.

First branch 16 of the combiner 18 is connected to output terminal port 14 via a DC blocking capacitor 40. The anode of pin diode 42 is connected to the output side of quarter wavelength transmission line 26. The cathode of pin diode 42 is connected to electrical ground.

Second branch 17 of combiner 18 is connected to output port 16 via DC blocking capacitor 44. The cathode of pin diode 46 is connected to the output side of quarter wavelength transmission line 30 of second combiner branch 16. The anode of pin diode 46 is connected to blocking capacitor 46 and to a diode biasing network 48.

Diode biasing voltage is supplied at control terminal 50. The control terminal 50 is connected to the anode of pin diode 46 via current limiting resistor 52, and the RF filtering circuit of inductor 54 and capacitor 56.

In operation, a signal presented at input terminal 12 may be directed to either output port 14 or output port 15 depending on the bias voltage presented at control terminal 50. For example, a positive voltage (e.g. +10 volts) applied to the control terminal 50 will activate output port 15, while a negative voltage (e.g. −10 volts) applied to the control terminal 50 will activate output port 14, while deactivating output port 15.

In more detail, when a positive voltage is applied to the control terminal 50, current ($I_{cl}$) will flow through pin diodes 46 and 42. In this regard, it will be noted that quarter wavelength transmission lines 24, 26, 28 30 provide a DC path between the diodes 46, 42. The pin diodes 46, 48 typically have a very low on resistance (less than 2 ohms). When biased with a positive voltage at control terminal 50, diode 46 provides a series path for the signal presented at input terminal 12 to flow from the input terminal 12 to output port 15. Concurrently, the positive biasing of pin diode 42 provides a low resistant path to ground, thereby deenergizing output port 14.

It will be appreciated that DC blocking capacitors 36, 38, aligned in series with balancing resistors 32, 34, present a low impedance to alternating current, but prevent DC current from flowing through the balancing resistors 32, 34. The balancing resistors 32, 34 are therefore unaffected by the presence by biasing voltage presented at control terminal 50. As will also be appreciated, the quarter wavelength transmission line 26 reflects the low impedance of pin diode 42, and when the diode 42 is forward biased, transforms that impedance to a very high impedance at the junction (as indicated by character a) between quarter wavelength transmission lines 24 and 26.

Both diodes 42 and 46 are reversed biased when a negative voltage is applied at control terminal 50. The reverse biasing of diode 46 presents a high impedance in series between quarter wavelength transmission line 30 and output port 15, thereby effectively deactivating output port 15. The reverse biasing of diode 42 essentially cuts off the path to ground from the output side of quarter wavelength transmission line 26, that was previously presented by the forward biasing of the diode 42. Output port 14 is thereby activated by the reverse biasing of diode 42.

The SPDT switch as herein disclosed provides to approximately 25 db isolation between output ports 14 and 15. As a result, ports 14 and 15 can be terminated into loads with widely dissimilar load impedances, without presenting load feedback between the two ports.

We claim:

1. A multiple throw switch, comprising:

first, second, and third signal ports;

a first signal transmission line operably coupling said first and second signal ports;

a second signal transmission line operably coupling said first and third signal ports, said first and second signal transmission lines being operably coupled to define a DC current path therealong;

a voltage balancing network comprising a first resistive element and a first capacitive element in series, said network connected in shunt across said first and second signal transmission lines;

first and second asymmetrical conducting elements respectively operably coupled to said first and second signal transmission lines, each of said asymmetrical conducting elements selectively biasable between a transmission line enabling operating condition and a transmission line disabling operating condition; and control means for selectively biasing said asymmetrical conducting elements, said DC current path comprising means for operably coupling said control means to at least one of said asymmetrical conducting elements.

2. A switch as claimed in claim 1, each of said transmission lines comprising first and second one quarter wavelength reactive elements aligned in series.

3. A switch as claimed in claim 2, each of said reactive elements having opposed ends, respective ends of said first reactive elements being connected at a common connecting node, and the opposed end of each of said first reactive elements being connected to respective ends of said second reactive elements at intermediate transmission line nodes, said first resistive element and said first capacitive element being connected between said first and second transmission lines at said intermediate transmission line nodes.

4. A switch as claimed in claim 3, the opposed ends of said second reactive elements terminating at respective transmission line termination nodes, said voltage balancing network comprising a second resistive element and a second capacitive element in series connected between said first and second transmission lines at said termination nodes.

5. A switch as claimed in claim 4, said switch including a first capacitive member coupling said common connecting node to said first port, and second and third capacitive members connecting said first and second transmission line terminating nodes to said second and third signal transmission ports respectively.

6. A switch as claimed in claim 5, said first asymmetrical conducting elements operably connected between said first transmission line and electrical ground, and said second assymetrical conducting element operably connected in series with said second transmission line, said first and second assymetrical conducting elements being operably connected in series between electrical ground and said control means by said DC current path.

* * * * *